US007524233B1

(12) United States Patent
Reilley

(10) Patent No.: US 7,524,233 B1
(45) Date of Patent: Apr. 28, 2009

(54) TOOL FOR USING A PARTICULATE MEDIA/FLUID MIXTURE

(75) Inventor: Edward M. Reilley, Porter Ranch, CA (US)

(73) Assignee: Comco, Inc., Burbank, CA (US)

( * ) Notice: Subject to any disclaimer, the term of this patent is extended or adjusted under 35 U.S.C. 154(b) by 0 days.

(21) Appl. No.: 11/486,259

(22) Filed: Jul. 13, 2006

(51) Int. Cl.
*B24C 5/04* (2006.01)

(52) U.S. Cl. ..... 451/38; 451/90

(58) Field of Classification Search ..... 451/75, 451/90, 102, 78, 99, 38, 39
See application file for complete search history.

(56) References Cited

U.S. PATENT DOCUMENTS 2,641,839 A * 6/1953 Black ..... 433/80
3,638,839 A 2/1972 Weightman
5,065,551 A 11/1991 Fraser
5,325,638 A 7/1994 Lynn
6,023,324 A 2/2000 Myers
6,106,377 A * 8/2000 Chu et al. ..... 451/102
6,622,983 B2 9/2003 Hall
6,799,968 B2 * 10/2004 Aumuller et al. ..... 433/88
2002/0173220 A1 11/2002 Lewin et al.

* cited by examiner

*Primary Examiner*—Robert Rose
(74) *Attorney, Agent, or Firm*—Stout, Uxa, Buyan & Mullins, LLP; Donald E. Stout

(57) ABSTRACT

A nozzle assembly for a tool which utilizes a particulate/fluid mixture comprises a unique floating ferrule within a handpiece assembly, and eliminates the need, in the prior art, for a nose piece to attach a nozzle to the handpiece assembly. Rather, the nozzle and its integral holder are designed so that a hose may be slipped over its extended rear tube and then, when the handpiece with its floating ferrule is twisted on, the hose is captured and sealed. This is managed because the ferrule is unengaged when the handpiece tube is first started to be threaded onto the nozzle holder. After a few turns, the ferrule pushes against the hose and seals it against the rear extension of the nozzle holder. When the handpiece is unscrewed from the nozzle, because the nozzle must be replaced, the ferrule remains attached to the nozzle and hose, allowing for easy turning. Once the handpiece is unscrewed from the nozzle, the nozzle may be tipped slightly to disengage it from the hose very easily.

18 Claims, 8 Drawing Sheets

TOOL FOR USING A PARTICULATE MEDIA/FLUID MIXTURE

RELATED APPLICATIONS

This application is related to two co-pending applications, filed on even date herewith, and commonly assigned. These applications are U.S. application Ser. No. 11/486,301, now U.S. Pat. No. 7,297,048, entitled Apparatus and Methods for Dispensing Particulate Media, and U.S. application Ser. No. 11/486,245, entitled Particulate Media Resistant Valve. Both of these applications are herein expressly incorporated by reference.

BACKGROUND OF THE INVENTION

The present invention relates generally to the bulk material handling field, and, more particularly, to tools for using particulate media/fluid mixtures, especially in particulate media dispensing apparatus and methods.

Particulate media dispensing systems are well known in the art. One such system is an abrasive particle blasting system such as the MICROBLASTER® system sold by Comco, Inc., of Burbank, Calif., the assignee of the present application. In this type of system, abrasive particles, typically in powdered form, are dispensed through a handheld nozzle, from a supply tank, so that an operator can cut, clean, deburr, drill, or texture nearly any surface of any type of workpiece.

While such systems as briefly described above are highly commercially successful, and in wide usage in the industry, there are certain system aspects and features which could be significantly improved. For example, there is a tendency in prior art systems for abrasive particles to rapidly wear ports and hoses forming part of those systems, thereby causing the need for maintenance down time in order to repair or replace the worn parts. There is also a need for greater and more precise control of the powder feed for various operational regimes.

In addition to the foregoing, better modulation of the fluid supply for systems of this type would be very useful, as well as improved particulate media resistant shut-off valves, particularly those that are capable of reliably keeping abrasive particles from penetrating into the valve mechanism.

SUMMARY OF THE INVENTION

The present invention is a greatly improved particulate media/fluid delivery system. Unlike prior art systems, the particulate media/fluid ratio is controlled in a precise fashion. This control is via differential modulation pressure. This differential modulation pressure is a function of two mechanisms, namely, the modulator in the system, including bypass (or blend) air around it that is metered, and a bypass tube for the tank. Fine adjustment of the particulate media/fluid ratio is by a panel flow control valve, which may be either manually or automatically controlled, and coarse adjustment is via change-out of the bypass tube with another bypass tube having a different internal diameter.

A particulate media resistant valve is provided for controlling the flow of a particulate media/fluid mixture. Prior art valves of this type utilize wipers and a positive pressure air bleed to keep abrasive particles out of the valve cylinder. The present invention uses positive pressure within a distal chamber of the cylinder, but does not require bleed air. The positive pressure is constant, and always higher than adjacent space pressure to prevent abrasive from penetrating into the valve mechanism. The fluid to the area behind the shaft seals is always at a maximum system pressure (or at least always higher than the fluid/particulate media mixture pressure). Seals on the piston shaft prevent fluid (typically air) from freely flowing into the abrasive side and thus diluting or change the fluid/particulate ratio. The valve has a minimum number of parts, is easily repaired if necessary, and inexpensive to manufacture.

When the fluid/particulate mixture is to be directed by the operator using some kind of flexible hose and a nozzle, a convenient and useful device is required. Because the fluid/particulate mixture can be flowing at a very high velocity and is restricted to a small diameter, the nozzle and the components associated with it can wear very rapidly. Having an easily replaceable nozzle, made from highly wear-resistant material, separates the high wear items from the lower wear parts held by the hand, and thus simplifies both cost and maintenance of the system.

Typical prior art nozzles often comprise an aluminum holder which carries a metal carbide alloy tube nozzle bonded therein. The nozzle-holder combination is screwed into a handpiece nose which couples the delivery hose to it by means of a handpiece tube. It is difficult to assemble this combination to form a pressure-tight seal between the hose and the nose, and, after some time connected in this manner, it is often difficult to remove the nose from the assembly because of friction between the hose and the handpiece tube.

The present inventive nozzle solves this problem by incorporating a unique floating ferrule within the handpiece tube, and eliminates the need for a nose piece. Rather, the nozzle and its integral holder are designed so that the hose may be slipped over its extended rear tube and then, when the handpiece with its floating ferrule is twisted on, the hose is captured and sealed. This is managed because the ferrule is unengaged when the handpiece tube is first started to be threaded onto the nozzle holder. After a few turns, the ferrule pushes against the hose and seals it against the rear extension of the nozzle holder.

When the handpiece is unscrewed from the nozzle, because the nozzle must be replaced, the ferrule remains attached to the nozzle and hose, allowing for easy turning. Once the handpiece is unscrewed from the nozzle, the nozzle may be tipped slightly to disengage it from the hose very easily.

More particularly, there is provided a particulate media dispensing system which comprises a tank for containing a supply of particulate media, preferably an abrasive powder. A modulator is disposed upstream of the tank for modulating the pressure of air flowing therethrough, and is preferably oriented substantially vertically and comprises a substantially cylindrical ferromagnetic core. A mixing chamber is adjacent to the tank, and an orifice is provided for delivering particulate media from the tank into the mixing chamber. A fluid inlet delivers fluid from the modulator to the tank, and a bypass tube is disposed adjacent to the fluid inlet for receiving fluid from the fluid inlet and delivering the fluid into the tank. A fluid passage permits fluid from the fluid inlet to flow directly into the mixing chamber. A discharge port is provided for delivering a fluid/particulate media mixture from the mixing chamber to a workpiece. Advantageously, the bypass tube is interchangeable with other bypass tubes of various internal diameters, in order to control a maximum level of flow of particulate media to the mixing chamber.

Another advantageous feature of the present invention is a fluid/particle flow control which is disposed upstream of the tank, in a fluid flow passage disposed in parallel with the modulator, in order to permit changes in particulate flow during operation of the system. A particulate-resistant shut-off valve permits selective opening and closing of the discharge port. The modulator is arranged to function as a check valve to prevent backflow of particulate media upstream of the modulator. The flow path from the orifice to the discharge port is substantially straight, with no sharp turns or bends, in order to minimize directional changes of the particulate media/fluid mixture.

In another aspect of the invention, there is provided a particulate media dispensing system, which comprises a fluid inlet, a tank for containing a supply of particulate media, and a modulator disposed in a first fluid passage between the fluid inlet and the tank for modulating the pressure of fluid flowing therethrough. A second fluid passage is disposed in parallel to the first fluid passage and the modulator, and a flow control is disposed in the second fluid passage. Adjustment of the flow control permits instantaneous, real-time adjustment of particulate media flow in the system during operation of the system. An orifice is provided at a lower end of the tank for releasing particulate media from the tank. The bypass tube is disposed upstream of the orifice.

In preferred embodiments of the invention, the modulator is disposed in a location remote from the tank. A particulate media flow sensor, preferably a powder flow transducer, may be disposed downstream of the discharge port, for sensing a particulate media flow rate. A feedback loop for adjusting the flow control based upon particulate media flow sensor readings may be provided as well.

In yet another aspect of the invention, there is disclosed a method for operating a particulate media dispensing system which dispenses a particle/fluid mixture, wherein the system comprises a tank for containing a supply of particulate media, a modulator upstream of the tank for modulating the pressure of fluid flowing therethrough, a mixing chamber adjacent to the tank, an orifice for delivering particulate media from the tank into the mixing chamber, a fluid inlet for delivering fluid from the modulator to the tank, and a bypass tube disposed adjacent to the fluid inlet for receiving fluid from the fluid inlet and delivering the fluid into the tank. The method comprises a step of selecting a particular bypass tube having a desired internal diameter and substituting the particular bypass tube for the bypass tube already in place, as well as a step of switching the system to an operational mode. An additional step comprises selecting a second particular bypass tube having a second different internal diameter and substituting the second particular bypass tube for the particular bypass tube, in order to adjust powder flow rates in the system.

In addition to the foregoing, the inventive system preferably comprises a flow control disposed in parallel to the modulator for controlling fluid inflowing to said tank, wherein the disclosed method includes a further step of actuating the flow control in order to change the particle/fluid mixture which is dispensed from the system during operation of the system.

In still another aspect of the invention, there is disclosed a method for operating a particulate media dispensing system which dispenses a particle/fluid mixture, wherein the system comprises a tank for containing a supply of particulate media, a modulator upstream of the tank for modulating the pressure of fluid flowing therethrough, a mixing chamber adjacent to the tank, an orifice for delivering particulate media from the tank into the mixing chamber, and a fluid inlet for delivering fluid from the modulator to the tank. The method comprises a step of initiating the system to an operational mode, as well as a second step of adjusting a rate of flow of the particulate media by changing modulation intensity in the system.

In another aspect of the system, there is provided a particulate media resistant shut-off valve, preferably for use in a particulate media dispensing system. The system comprises a cylinder, a piston reciprocable within the cylinder, and a rod connected to the piston. The rod has a distal end which extends from the cylinder for selectively opening and closing a port outside of the cylinder. A spring is provided for biasing the piston and the rod to an orientation wherein the port is closed. A first fluid port permits fluid to flow into and out of a first chamber within a proximal end of the cylinder, on a proximal side of the piston. A second fluid port permits fluid to flow into and out of a second chamber within the cylinder which is on a distal side of the piston. Advantageously, in order to protect the cylinder from incursion by particulate media, pressurized fluid is always introduced into the second chamber through the second fluid port when the particulate media dispensing system is operational, wherein the term "operational" means that the system is either pressurized or actually being used to blast a workpiece. The purpose of this feature is to ensure that fluid pressure in the second chamber is always higher than fluid pressure in the mixing chamber when the particulate media dispensing system is operational.

The first fluid port is vented to reduce fluid pressure in the first chamber sufficiently so that the biasing force applied by the spring is overcome in order to actuate the valve to an open orientation. On the other hand, pressurized fluid is introduced into the first fluid port in order to actuate the valve back to a closed orientation. An aperture is provided at the distal end of the cylinder for permitting the rod to reciprocate into and out of the cylinder. A washer and felt wipers disposed along the rod adjacent to the aperture assist in keeping contaminants out of the cylinder. A particulate media/fluid mixing chamber is disposed distally of the cylinder, wherein the discharge port provides an exit passage from the mixing chamber.

A tank is provided for containing the aforementioned particulate media. The tank and the particulate media resistant shut-off valve preferably form part of a common housing.

In yet another aspect of the invention, there is provided a particulate media resistant shut-off valve, preferably for use in a particulate media dispensing system. The system comprises a cylinder, a piston reciprocable within the cylinder, and a rod connected to the piston. The rod has a distal end which extends from the cylinder and may be seated within a port outside of the cylinder for closing the port. A first fluid port permits fluid to flow into and out of a first chamber within a proximal end of the cylinder, on a proximal side of the piston, and a second fluid port permits fluid to flow into and out of a second chamber within the cylinder which is on a distal side of the piston. Advantageously, pressurized fluid is always introduced into the second chamber through the second fluid port when the particulate media dispensing system is operational.

An aperture in a distal end of the cylinder permits the rod to reciprocate into and out of the cylinder. A washer and felt wipers are disposed along the rod adjacent to the aperture to assist in keeping contaminants out of the cylinder. A particulate media/fluid mixing chamber is disposed distally of the cylinder, wherein the discharge port provides an exit passage from the mixing chamber. A tank is provided for containing the particulate media, wherein, preferably, the tank and the particulate media resistant shut-off valve comprise a part of a common housing.

Operationally, pressurized fluid is introduced into the first fluid port in order to actuate the valve to a closed orientation. A spring biases the piston and the rod to this closed orientation in the absence of sufficient fluid pressure present in the system to overcome this biasing force. The first fluid port is vented to reduce fluid pressure in the first chamber sufficiently so that the biasing force applied by said spring is overcome in order to actuate the valve to an open orientation.

In still another aspect of the invention, there is provided a particulate media resistant shut-off valve, preferably for use in a particulate media dispensing system. The system comprises a cylinder, a piston reciprocable within the cylinder, and a rod connected to the piston. The rod has a distal end which extends from the cylinder through an adjacent space outside of the cylinder, and may be seated within a port outside of the cylinder for closing the port. A spring is provided for biasing the piston and the rod to a particular orientation. A first chamber within the cylinder is in a proximal end of the cylinder, on a proximal side of the piston, and a second chamber within the cylinder is on a distal side of the piston. Advantageously, a fluid pressure in the second chamber is always maintained to be higher than a fluid pressure in the adjacent space outside of the cylinder when the particulate media dispensing system is operational, so that the particulate media resistant shut-off valve remains clean.

Another advantage of the present invention is that the particulate media resistant shut-off valve is fully operational using only a single fluid supply for supplying both fluid pressure for reciprocating the piston and fluid pressure for pressurizing the second chamber. In prior art systems requiring bleed air, two different fluid supplies, at different fluid pressures, are required.

In yet another aspect of the present invention, there is provided a tool for utilizing a particulate media/fluid mixture to modify a workpiece. The tool comprises a handpiece assembly having a grip and a tube for receiving the particulate media/fluid mixture from a source, wherein the tube extends through the grip from a proximal end to a distal end thereof. A nozzle is directly engageable with the distal end of the handpiece assembly. Advantageously, a ferrule is provided, which is movable within the handpiece assembly to engage the nozzle when it is attached to the handpiece assembly and to disengage the nozzle when it is detached from the handpiece assembly, thus permitting much easier and quick assembly and disassembly of the nozzle and handpiece combination.

In the present invention, the nozzle directly engages a distal end of the tube, and includes a proximal fluid inlet nipple which is insertable into the distal tube end. The nozzle includes a set of male threads, and female threads are provided in the distal end of the handpiece. The nozzle is directly engageable with the handpiece assembly by threadedly engaging the male and female threads.

Advantageously, for user comfort, the handpiece assembly grip has a relatively large diameter and is sized to cradle a user's fingers. To ensure durability, the fluid inlet nipple is fabricated from an abrasive resistant media, preferably stainless steel. The particulate media preferably comprises abrasive powder of known composition, and the tool preferably comprises a cutting or finishing tool, although other types of tools are within the scope of the present invention. The nozzle preferably comprises a body, and the nozzle body has markings thereon, such as grooves or unique coloring schemes, for the purpose of identifying predetermined characteristics of the nozzle. These characteristics may include, for example, internal diameter, rated flow capacity, and the like.

The handpiece assembly also comprises a handpiece nut, wherein the ferrule is captured between the handpiece nut and the handpiece tube. When the handpiece assembly is connected to the nozzle, the ferrule cinches the tube.

In still another aspect of the invention, there is disclosed a method of assembling and disassembling a tool for utilizing a particulate media/fluid mixture to modify a workpiece. The tool comprises a handpiece assembly having a grip, and a tube for receiving the particulate media/fluid mixture from a source, wherein the tube extends through the grip from a proximal end to a distal end thereof. The tool further comprises a nozzle, and a ferrule which is movable within the handpiece assembly to engage the nozzle when it is attached to the handpiece assembly and to disengage the nozzle when it is detached from the handpiece assembly. The disclosed method comprises a step of connecting a distal end of the tube to an inlet nipple on the nozzle, and a second step of connecting a distal end of the handpiece assembly to a proximal end of the nozzle. The step of connecting the distal end of the handpiece assembly to the proximal end of the nozzle is preferably performed by threadedly engaging the two components. The ferrule cinches the tube during the step of connecting the distal end of the handpiece assembly to the proximal end of the nozzle. As a result of this process, the ferrule creates a pressure tight seal between the tube and the nipple, and reduces the amount of torque which would otherwise be required to perform the step of connecting the distal end of the handpiece assembly to the proximal end of the nozzle.

It is often desired to disassemble the nozzle from the handpiece assembly, typically because of nozzle wear, but also potentially because of a desire to change-out the nozzle in order to perform a different operation. In such a case, the inventive method discloses a further step of disconnecting the nozzle from the handpiece assembly by unthreading the handpiece assembly from the nozzle, wherein the ferrule remains attached to the tube/nipple interface during the unthreading step in order to render the unthreading process easier to accomplish. Then, the nozzle is tipped in order to separate it from the hose.

The invention, together with additional features and advantages thereof, may be best understood by reference to the following description taken in conjunction with the accompanying illustrative drawings. In these accompanying drawings, like reference numerals designate like parts throughout the figures.

DETAILED DESCRIPTION OF THE INVENTION

Figure 1:
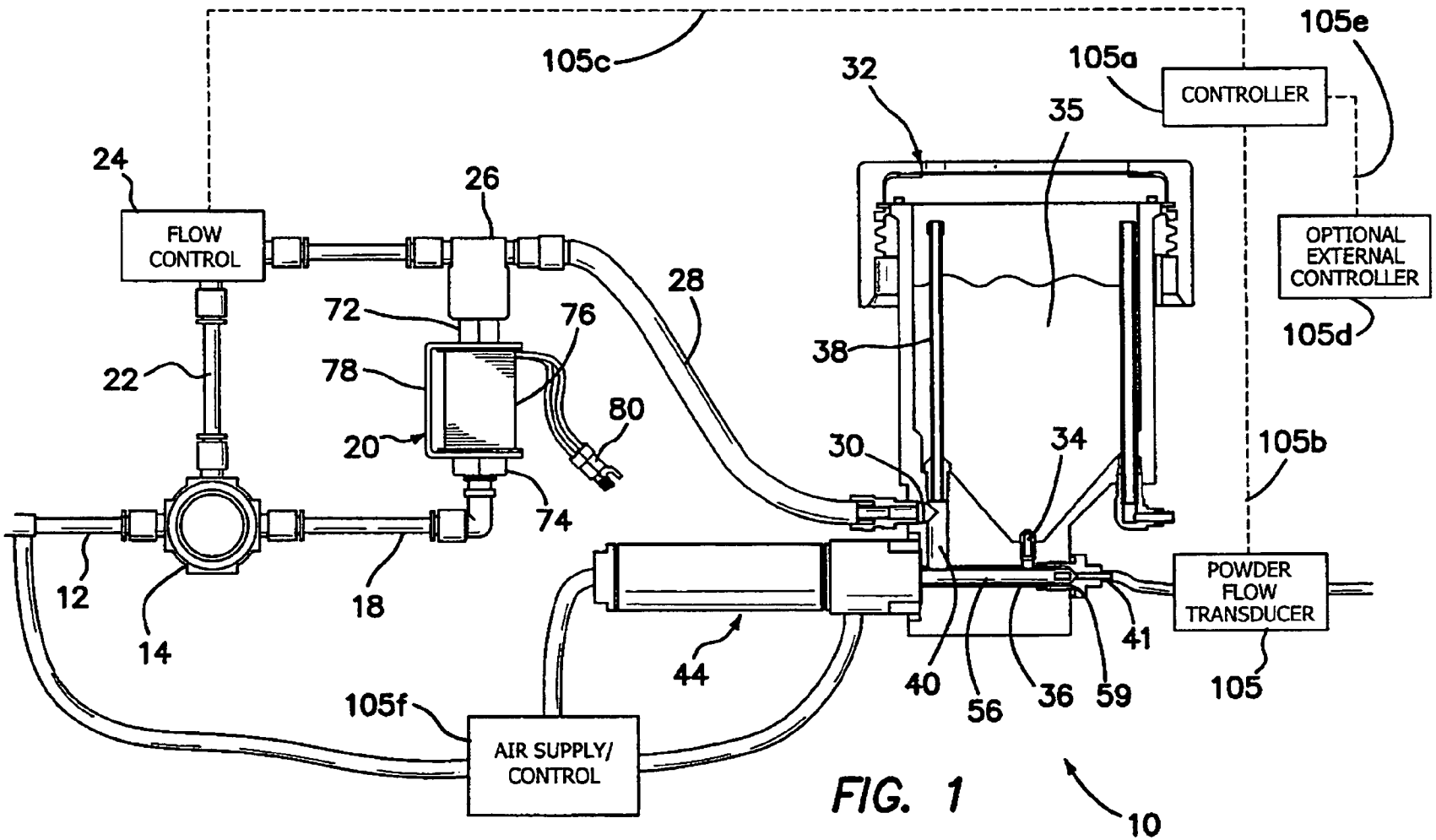
FIG. 1 is a schematic view of a particulate media dispensing system constructed in accordance with the principles of the present invention.

Referring now more particularly to FIG. 1, there is diagrammatically shown a particulate media dispensing system 10 according to the invention, which comprises a fluid inlet 12 flowing into a blast pressure regulator 14. The working fluid is typically air. From the blast pressure regulator 14, a first fluid passage 18 terminates at a modulator 20, while a second fluid passage 22 terminates at a flow control 24. Fluid flowing from the exits of each of the modulator 20 and the flow control 24 then re-converge through a fitting 26. A third fluid passage 28 carries fluid from the fitting 26 to a fluid inlet 30 near the bottom of a particulate media tank 32.

Figure 2:
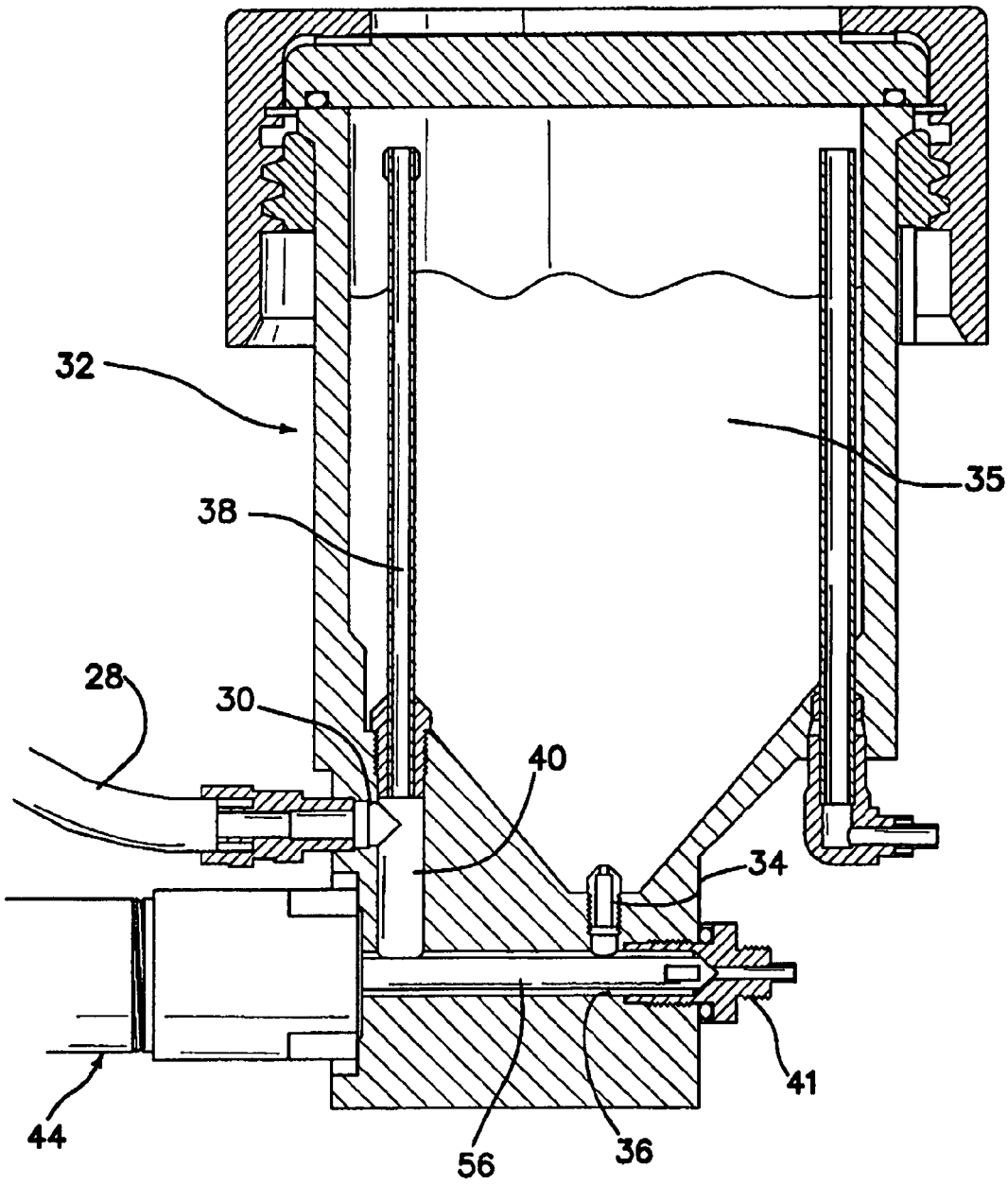
FIG. 2 is a schematic view of the tank geometry and mixing chamber portions of the system of FIG. 1, showing the system in a non-blasting state.
Figure 3:
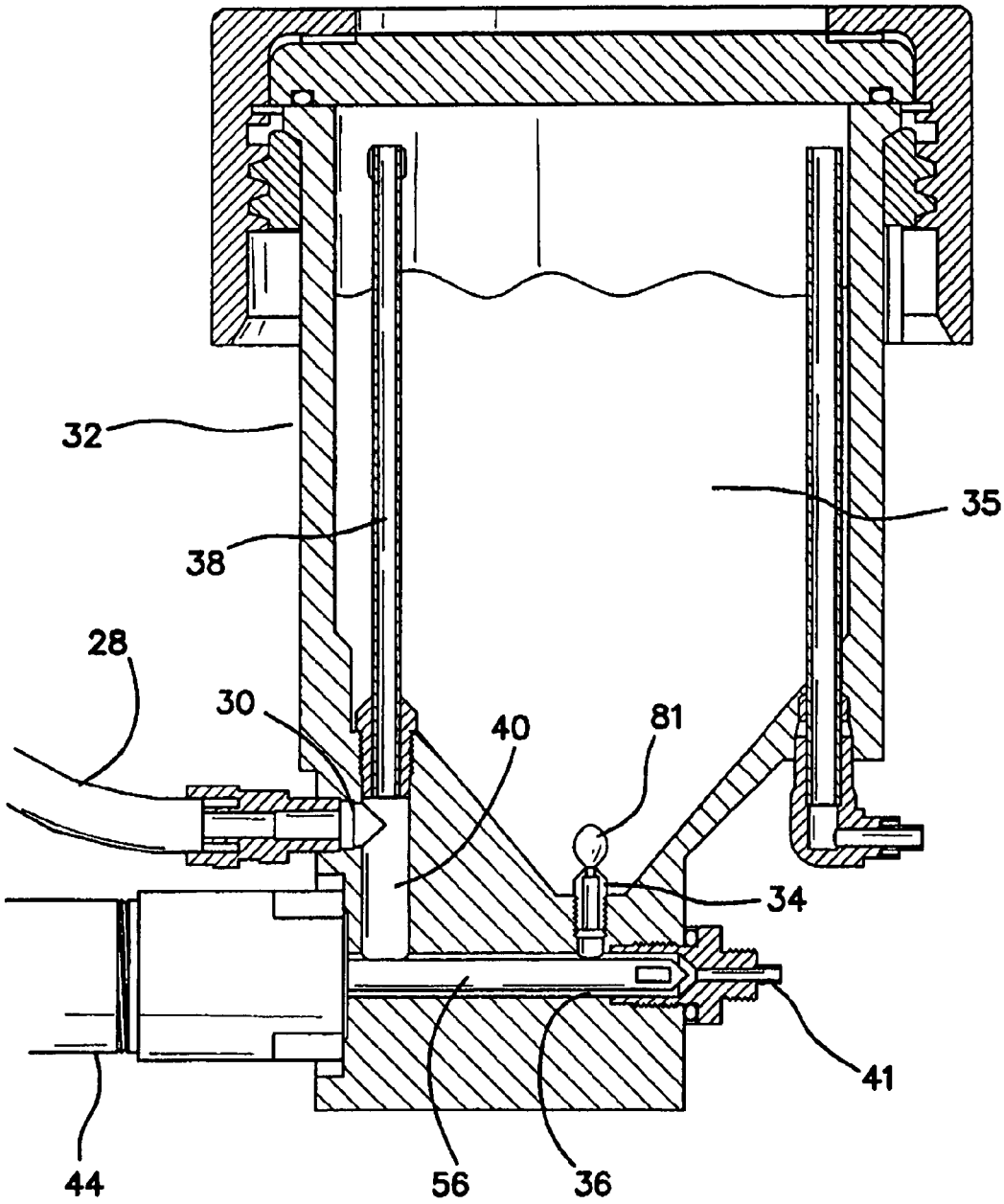
FIG. 3 is a schematic view similar to that of FIG. 2, wherein the system is in a blasting state.

Now with continuing reference to FIG. 1, as well as FIGS. 2 and 3, which show in greater detail the system elements in the vicinity of the tank 32, it can be seen that an orifice 34 is disposed at the base of the tank 32. The tank 32 is filled with a suitable particulate media 35. Typically, this particulate media comprises abrasive media in powdered form, as is well known in the art, but other types of particulate media, including non-abrasive media, are within the scope of the present invention. This particulate media 35 is fed at a metered rate through the orifice 34 and exits into a mixing chamber 36 for blending the particles, preferably in powdered form, with an appropriate volume of air passing through the mixing chamber. The rate of particulate media feed is controlled as described in detail below. Air entering through the air inlet 30 either travels upwardly through a bypass tube 38, the function of which will be described in more detail below, or downwardly through a fluid passage 40 to the mixing chamber 36. A discharge port 41 dispenses the powder/air mixture through a flexible or rigid particulate-resistant plumbing, often polyurethane tubing, to a tool 42 (FIG. 8) for use, typically, in a microabrasive blasting operation on a selected workpiece.

Also connected to the mixing chamber 36 is a particulate media resistant shut-off valve 44. Prior art particulate media resistant valves of this type are sold by the assignee of the present invention, Comco, Inc., under the trademark "PowderGate"™. The particulate media resistant valve 44 is shown in greater detail in FIG. 6, and works in conjunction with the discharge port 41 to dispense the particle/air mixture in the mixing chamber 36 to the tool 42. The particulate media resistant valve 44 comprises a first fluid port 46 and a second fluid port 48 within a cylinder 52. The first fluid port 46 communicates with a first cylinder chamber 49 in a proximal end of the cylinder 52, and the second fluid port 48 communicates with a second cylinder chamber 50 in a distal end of the cylinder 52. A piston 54 is engaged with a rod 56, which are reciprocable together within the cylinder 52. The chamber 49 is on a proximal side of the piston 54, and the chamber 50 is on a distal side of the piston 54. The rod 56 reciprocates within a plain bearing 58 and a plurality of cup seals 60. The distal end of the particulate media resistant valve 44 is also illustrated in FIGS. 1-3, and the operation of the particulate media resistant valve 44 will be described in greater detail below. A heavy spring 61 is provided for biasing the piston 54 to a closed orientation. The distal end of the rod 56 is covered by a pliable seal 59 that interfaces with the discharge port 41. The above mentioned first fluid port 46 and second fluid port 48 are provided to allow air pressure to act on either side of the piston 54. To open the particulate media resistant valve, air pressure is applied to port 48 while port 46 is vented. To close the particulate media resistant valve 44, air pressure is applied to port 46 and port 48 simultaneously, thus allowing the heavy spring 61 to force the pliable seal 59 into contact with the discharge port 41. To protect the inside of the cylinder 52 against abrasive contamination, the air pressure in port 48 is maintained to be greater than the air pressure in the mixing chamber 36. The device is plumbed so that there is always air pressure applied to the port 48 whenever the system is operational, meaning whenever air pressure is present in the tank 32 and the mixing chamber 36.

In the preferred embodiment illustrated, the particulate media resistant valve 44 is built into the tank 32 to reduce part costs and simplify assembly of the system. The particulate media resistant valve 44 and discharge port 41 are screwed or otherwise mounted to the tank 32, and are easily replaceable.

It should be noted that the particulate media resistant valve 44 is preferred for use in the inventive system 10, but is not necessary for its operation. For example, pinch valves, known in the prior art, may be used instead of the particulate media resistant valve 44.

Operationally, a blast cycle is started by an operator by simultaneously actuating the particulate media resistant valve 44 to an open position and engaging a power supply to the modulator 20, typically using a foot pedal (not shown), or other suitable actuator. The other controls noted above, such as the abrasive blend flow control 24, are typically located on an operator console (also not shown). To adjust the maximum level of powder flow, the bypass tube 38 is changed out, substituting a bypass tube having a different internal diameter. To make on-the-fly, generally smaller adjustments in powder flow, the aforementioned abrasive blend flow control knob 24 may be manipulated. These are described in more detail below.

Figure 4:
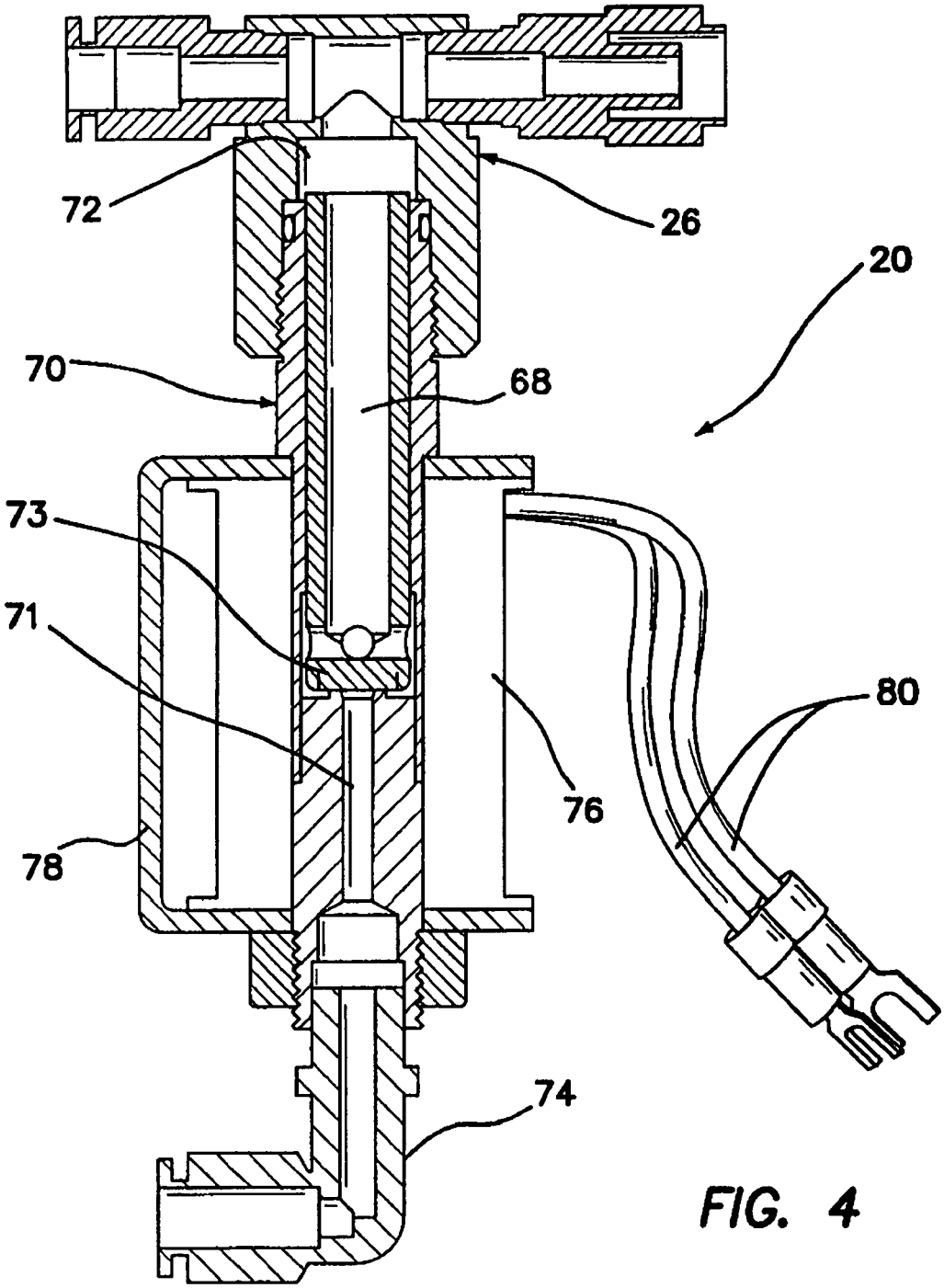
FIG. 4 is a cross-sectional view of the modulator employed in the system of FIG. 1, illustrated in a closed state.
Figure 5:
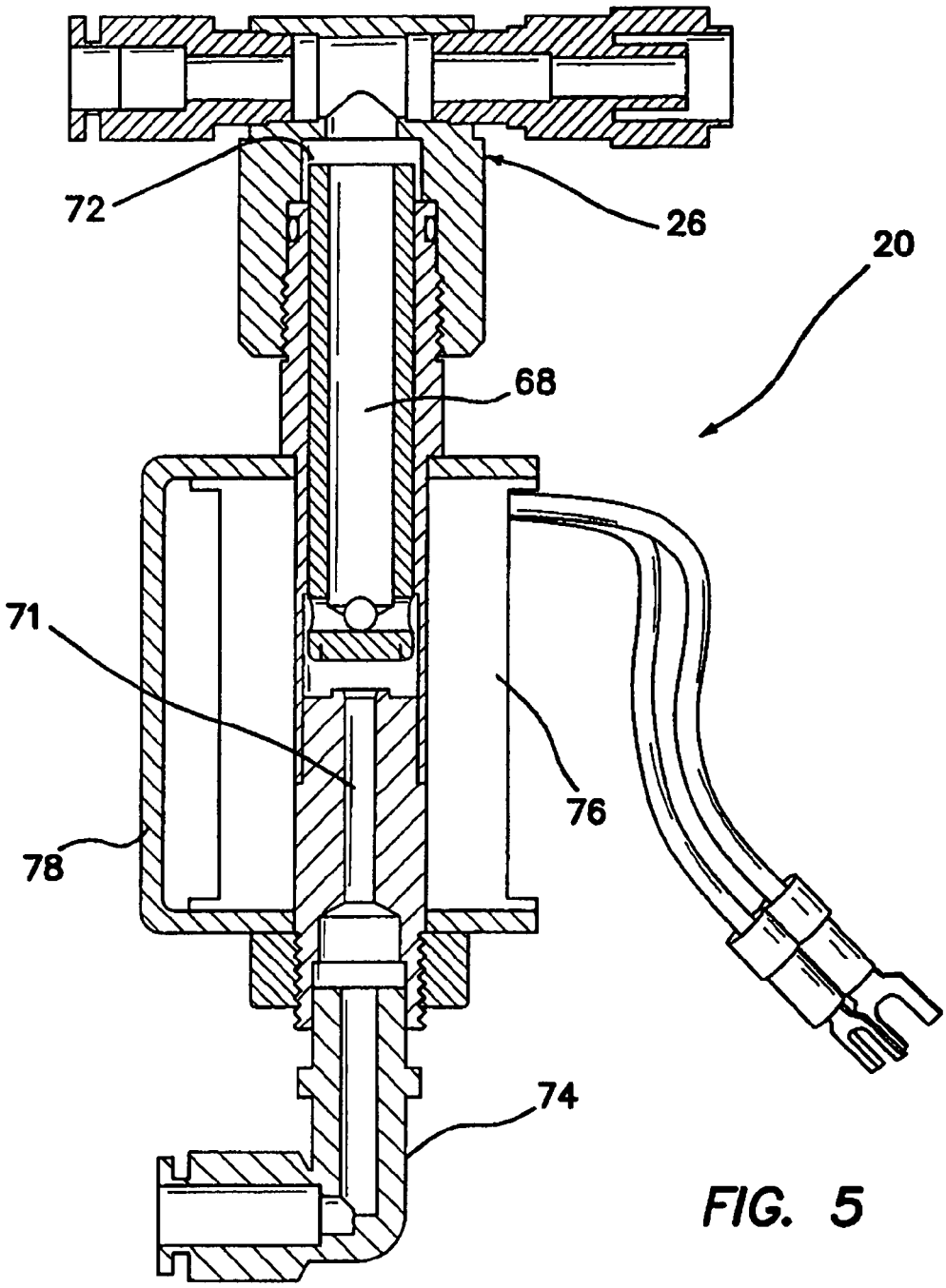
FIG. 5 is a cross-section view similar to that of FIG. 4, showing the modulator in an open state.

Referring now particularly to FIGS. 4 and 5, the modulator 20 is shown in greater detail. The modulator 20 is preferably a reciprocating-poppet solenoid valve. Modulators of this type are described in detail in U.S. Pat. No. 3,638,839 (the '839 patent), which is commonly assigned herewith and is herein expressly incorporated by reference.

The modulator 20 comprises a ferromagnetic circular core 68, as opposed to non-circular cores known in the prior art, and is mounted vertically and remotely from the tank 32, as shown in FIG. 1. The circular core 68 is contained in a tight fitting magnetically permeable housing 70, and is able to reciprocate up and down, bounded by a ferromagnetic seat 71 at the bottom and a shoulder 72 at the top. A pliable seal 73 is disposed in the lower end of the core and comes into contact with the seat 71 when the core is located at its lower end of travel. The core itself contacts the shoulder 72 at the top of travel, if such a stroke is achieved. A pneumatic fitting 74 is attached to the seat to provide a suitable pneumatic entrance. Similarly, two pneumatic fittings are attached to the fitting 26. A coil 76, preferably a fine-wire wound plastic bobbin used to generate a magnetic field, bounded by a magnetic yoke 78, is positioned around the housing 70 and seat 71 and retained by a nut. The magnetic yoke 78 can also be used as a mounting bracket to hold the entire modulator 20. Electrical leads 80 are adapted to connect to a power supply (not shown) for energizing the coil 76.

Air passing through the passage 18 enters the modulator 20 through the pneumatic fitting 74. The air then passes through the seat 71, around the lower tip of the core 68, and through the hollow center of the core 68, exiting through the fitting 26.

The power supply for the modulator 20 is an oscillating power supply, which is connected to the solenoid coil to periodically energize and de-energize the coil. When energized, the coil magnetizes the ferromagnetic core 68 and seat 71. When magnetized, the core and seat are strongly attracted to one another and pull together, forcibly causing the seal 73 to come into contact with the seat 71 (FIG. 4). The seal is a pliable (elastomeric or otherwise) material that deforms around the rounded edges of the seat, thereby shutting off air flow through the modulator. The air in the system, downstream of the modulator, continues to drain away through the open discharge port 41, thereby reducing pressure in the associated plumbing. Air pressure on the upstream side of the modulator is controlled by the regulator 14 and remains at its previous pressure, thereby creating a pressure differential across the sealed modulator 20.

When the power supply de-energizes the coil 76, the ferromagnetic core 68 and seat 71 are de-magnetized and no longer attract one another. The pressure differential causes the core 68 to slide away from the seat 71 and air is again allowed to flow through the modulator 20 (FIG. 5). This in-rush of air re-pressurizes the plumbing of the system, thus bringing it back up to the previous pressure. The energize/de-energize cycle of the modulator coil 76 is repeated many times per second and results in an oscillating pressure field inside the plumbing. This pulsing effect is particularly important inside the mixing chamber 36.

Because of its comparatively large volume, the top of the tank 32 (where the particulate media 35 is stored) remains at a comparatively constant pressure with respect to the mixing chamber 36. This is because the modulator 20 only shuts off air for a fraction of a second, and there are simply too many air molecules in the top of the tank to drain off in such a short period of time. Therefore, the top of the tank remains substantially unfazed by the highs and lows of the modulation and remains at the mean pressure of those highs and lows.

During the positive pressure surges created by the modulator 20, the air pressure in the mixing chamber forces air up through the orifice 34 into the comparatively lower (albeit substantially constant) pressure particulate tank, causing a localized fluidization of the particulate above the orifice, in a fluidization zone 81 shown in FIG. 3. On the negative pressure swing, that same air, now a cloud of air and particulate, is forced back down out of the orifice 34, into the mixing chamber 36, and ultimately exits through the discharge port 41. Repeating many times per second, powder is thereby fed at a metered rate out of the discharge port.

It has been found that modulation pressure intensity controls the powder feed rate through the orifice 34. More specifically, a higher pressure positive surge causes more air to pass through the orifice 34 into the tank 32, and thus fluidizes a larger region of powder, thereby increasing the size of the fluidization zone 81. This larger cloud is fed back down through the orifice on the negative pressure swing. Similarly, a smaller positive surge fluidizes a smaller region 81, and thereby feeds a lesser amount of abrasive. To control this, a portion of the incoming air may pass through the fluid passage 22, thus being subject to control by the abrasive blend flow control 24, rather than passing through the modulator 20. The abrasive blend flow control 24 is in parallel with the modulator 20, as discussed above. Thus, the abrasive blend flow control 24 is able to effectively reduce the amount of powder output from the orifice 34 by diluting modulated air pulses with steady air. Thus, when the flow control 24 is closed, the modulation pulses are untouched, and at their strongest level. Opening the flow control 24 permits unmodulated air to flow therethrough, which bypasses the modulator 20, thus reducing peak-to-peak pressure of the modulation. This directly reduces powder flow. A further benefit of the innovative abrasive blend flow control 24 is that it is upstream of the tank 32, and is thus not subject to abrasive contamination.

The function of the bypass tube 38 will now be described. The bypass tube 38 within the tank 32 plays the largest role in regulating abrasive flow. This is because of its location with respect to the tank orifice, and the modulated air inlet. As modulated air enters the tank 32 through the fluid passage 28 and air inlet 30, the pressure pulses will work on the top of the tank by going up into the top of the tank 32 via the bypass passage 38, and on the mixing chamber 36 via the passage 40. Modulated air pulses that work on the top of the tank are wasted, since they are trying to work on a comparatively large volume of air. Modulated air that enters the mixing chamber 36 feeds powder out of the orifice 34 at the bottom of the tank 32, as previously discussed. It is noted that the diameter of the bypass tube 38 can be changed by the operator, in accordance with desired performance. Relatively small bypass tubes force much more of the modulated air into the mixing chamber 36, while relatively large bypass tubes allow most of the modulated air into the top of the tank. Because powder feed from the tank 32 is directly linked to modulation intensity in the mixing chamber 36, smaller bypass tubes create very high powder flow. On the other hand, large bypass tubes create very low powder flow.

The size of the orifice 34 is another way in which powder flow rate can be managed. The orifice 34 is designed to be modular, having fittings suitable so that it can merely be changed out for a differently sized orifice when desired. Because there are two other methods for adjusting powder flow, the orifice can be selected based on the type of particulate media 35 in the tank 32. Orifice selection can be based on what creates the smoothest and/or most consistent powder flow for a given powder. For example, a small orifice may provide the most consistent flow with an easy flowing particulate media like 50 μm glass bead, and a larger orifice may produce the most consistent flow with a cohesive particulate media like 10 μm aluminum oxide.

Figure 8:
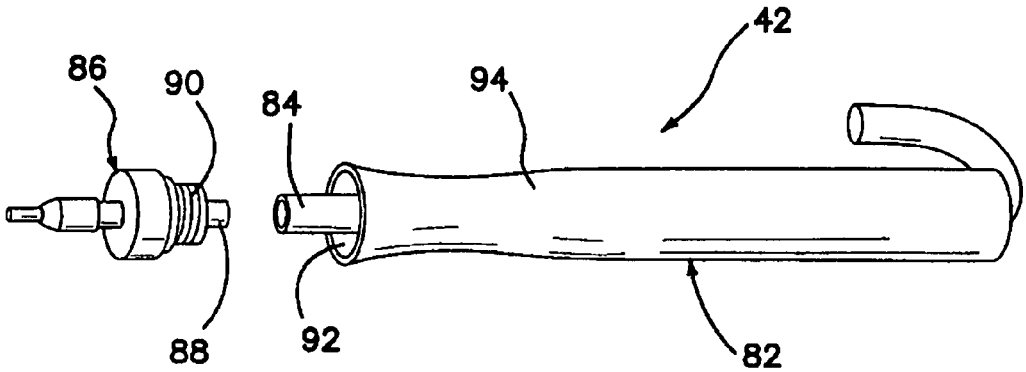
FIG. 8 is a view of a handpiece assembly and nozzle for use with the system of FIG. 1.

In FIG. 8, there is shown a tool 42 which may be used with the present invention. The tool 42 may have a number of different uses, such as cutting, finishing, deburring, and the like, and comprises a handpiece assembly 82 through which extends an elastomer tube 84, which typically comprises some kind of flexible hose having a sufficient length to permit the operator to freely manipulate the tool. The elastomer tube 84 is connected directly to a nozzle 86, whereby the interface between the tube 84 and the nozzle 86 is maintained by the handpiece assembly 82 as described below. Because the particle/air mixture can be flowing at a very high velocity and restricted to a small diameter, the nozzle 86 and the components associated with it can wear very rapidly. Having an easily replaceable nozzle, made from highly wear-resistant material, separates the high wear items from the lower wear parts held by the hand.

In the present invention, a nozzle 86 comprises a proximal fluid inlet nipple 88 which may be inserted into the end of the elastomer tube 84. Male threads 90 on the nozzle 86 may be engaged with female threads 92 in the handpiece assembly 82 in order to couple the nozzle 86 to the handpiece assembly 82 while simultaneously locking the elastomer tube 84 onto the inlet nipple 88. This approach permits the nozzle 86 to be directly connected to the elastomer tube 84 without the need for an intermediate adapter, like the nosepiece known in prior art arrangements, thus reducing cost and eliminating a wear item. Further, two-start threads are preferably used, thus requiring the handpiece assembly 82 only to be turned once or twice to be fully locked.

Because the nozzle 86 plugs directly into the hose, the inlet nipple 88 is preferably made from an abrasive resistant material, such as stainless steel. As such, the entire abrasive carrying portion of a nozzle body 99 is stainless steel, greatly increasing nozzle life. The tip 98 reduces the abrasive air stream to its final size before exit, and may be further hardened against abrasive wear by making it out of carbide or a similarly wear-resistant material. Tip size is identified by color of a nozzle holder 97. Internal differences affecting performance, such as nozzle life and abrasive exit speed, are identified by markings on the nozzle body 99. For example, in one particular embodiment, standard vs. high performance is identified by grooves on the shaft of the nozzle body. One groove means the nozzle is a standard nozzle, while two grooves means the nozzle is a high performance nozzle.

The handpiece assembly 82 has a relatively large diameter and a contoured rubber grip 94 which is sized to cradle the user's fingers naturally. Because the grip locates the user's fingers, there is no need to grip down tightly, thereby reducing operator fatigue. This handpiece and nozzle combination is capable of being retrofitted onto any existing system of the type disclosed herein.

Figure 9:
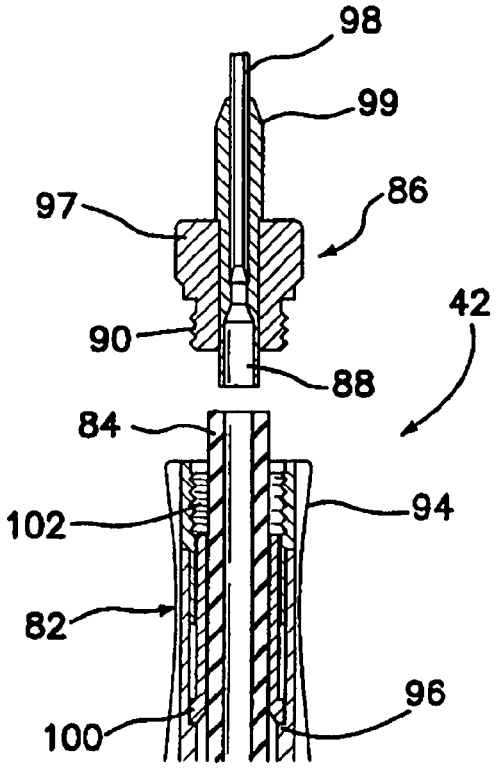
FIG. 9 is a cross-sectional view of the handpiece assembly and nozzle of FIG. 8 wherein it is in a free state.

FIGS. 9-12 illustrate the tool 42, in cross-section, in four respective states. In FIG. 9, the tool 42 is shown in a free state, wherein the handpiece assembly 82 comprises the aforementioned handpiece grip 94, a handpiece tube 96, a handpiece ferrule 100, and a handpiece nut 102. The ferrule 100 is captured axially between the handpiece nut 102 and handpiece tube 96.

Figure 10:
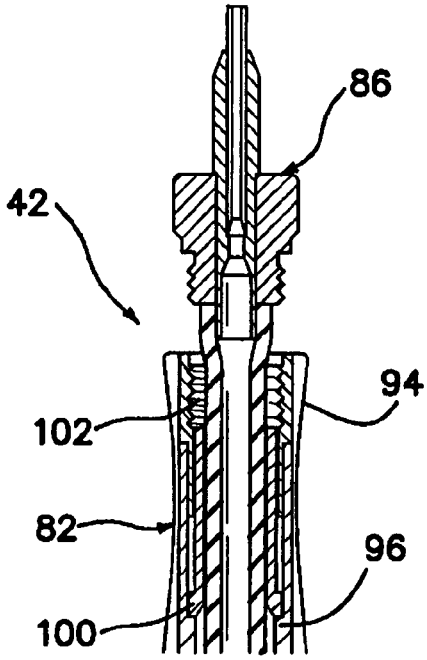
FIG. 10 is a view similar to FIG. 9, showing a state wherein a tube is forced around the nozzle of the handpiece.

In FIG. 10, the elastomer tube 84 has been forced around the inlet nipple 88 of the nozzle 86, as shown. The outer diameter of the inlet nipple 88 is larger than the inside diameter of the elastomer tube 84, causing a corresponding increase in the outside diameter of the tube as it is forced over the nipple.

Figure 11:
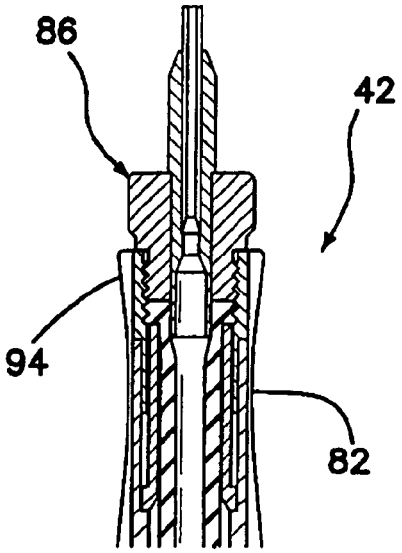
FIG. 11 is a view similar to FIGS. 9 and 10, showing the handpiece assembly connected to the nozzle, as well as a ferrule cinching the tube.

In FIG. 11, the handpiece assembly 82 has been screwed onto the nozzle 86, with the ferrule 100 cinching the tube. The floating ferrule creates a pressure tight seal between the tube and the nipple, while reducing the amount of torque required of the operator as compared to prior art. Because the handpiece assembly does not capture the ferrule in a rotational manner, the ferrule will rotationally attach itself (due to friction) with the tube as the handpiece assembly is threaded onto the nozzle. As the handpiece assembly turns, the bottom edge of the ferrule slides metal-to-metal with the handpiece tube, greatly reducing torque as compared to metal-to-rubber sliding in prior art. As the handpiece assembly is threaded onto the nozzle, the ferrule moves axially along the inlet nipple to cinch the tube to the nipple. In this state, the nozzle is ready for blasting operations.

Figure 12:
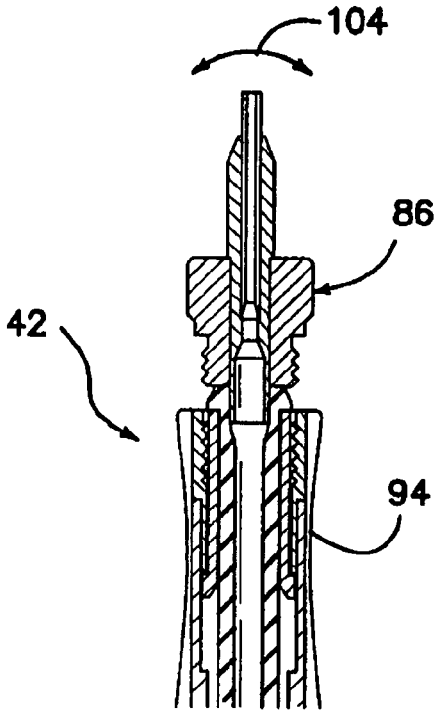
FIG. 12 is a view similar to FIGS. 9-11, wherein the handpiece assembly is partially disconnected from the nozzle.

Finally, in FIG. 12, the handpiece assembly is easily unscrewed from the nozzle, whereby the floating ferrule remains attached to the tube/nipple interface and little drag exists between the nozzle/ferrule/tube and handpiece assembly. After the handpiece assembly has been fully unscrewed, the nozzle may be tipped in any direction, as shown by arrow 104, to separate the nozzle from the tube and ferrule. Once separated, the outside diameter of the tube elastomerically returns to a smaller diameter and the ferrule is released.

Improved Modulator Performance and Wear Life

By increasing the diameter of the core, thinning the walls of the housing, relocating the seal to the core, and reconfiguring the interface between the core and the seat, the inventive modulator 20 is capable of generating a substantially stronger force between the core and the seat. Stronger forces are better able to resist premature core/seat separation due to pressure differential forces which exceed the magnetic force. It also means that the core and seat are able to strongly attract one another over a greater distance. This means that, for all but the largest nozzles, run at high pressures, the modulator core does not come into contact with the exit fitting. As such, the modulation air pulses are constant and repeatable for a much larger range of nozzle sizes than has been the case for prior art modulators. Further, this substantial reduction of undesired impacts greatly reduces wear on the modulator core and exit fitting in the present invention.

Advantageously, the present modulator 20 is supplied with a circular core 68, rather than the square core provided in prior art systems such as the one disclosed in the '839 patent. The entire modulator is mounted vertically, rather than horizontally, as in the prior art. The prior art square core make four line contacts with the housing, thereby wearing one or two distinct grooves in the bottom of the housing. Because the prior art modulator lays horizontally, these grooves continue to wear until the core no longer aligns properly with the seat, thus reducing the modulated air pulse intensity. The vertically mounted inventive modulator minimizes wear caused by the core laying in this horizontal fashion, as well as wear caused by the edges of the square-shaped core, since the inventive core is circular. Also, because the modulator is vertically mounted, if the upstream air pressure is reduced below the tank pressure, the device acts as a check valve to prevent the discharge of abrasive air mixture into the valves and regulator, which are located upstream.

Another advantage of the inventive modulator arrangement is that the modulator 20 need not be mounted in close proximity to the tank 32, though it may be. This permits the modulator to be mounted in a location that is convenient for service.

Powder Flow Adjustment by Varying Modulation Intensity

Tests by the inventors have shown that powder flow is related to modulation intensity. Higher modulation pressure pulses mean more powder flow. Because the bypass tube 38 is located next to the air inlet 30 in the present system, modulation in the mixing chamber 36 is directly affected by changing the diameter of the bypass tube, unlike in the prior art. Further, the abrasive blend flow control 24 allows instantaneous and dynamic adjustment of powder flow. This is particularly useful in cases where the present invention is used in a closed-loop control architecture.

With optional closed-loop control, as shown in FIG. 1, a powder flow meter or transducer 105 is provided for continuously monitoring powder flow. In this embodiment, the flow control 24 may comprise an electromechanical proportional flow control valve. A controller 105*a* receives feedback from the powder flow transducer 105, through a control line 105*b*, and, in turn, provides control feedback, via a control line 105*c* to the flow control 24, in order to automatically adjust powder flow level based on inputs from the powder flow meter 105.

In the case where the abrasive blend flow control is controlled mechanically or electromechanically, remote powder flow adjustment can be made automatically, by a host computer 105*d*, via a control line 105*e*, when the blaster is used in an automatic system, for example.

Start-Up Transient Shortened

A further substantial advantage as compared to the prior art is the reduced amount of time the system takes to achieve steady state powder flow. When the blast is actuated, it is desired to have particulate flow be immediately uniform. Since the tank and associated plumbing need to equalize their pressures as blasting begins, this goal is never fully realized, but is substantially improved in the herewithin described invention compared to the prior art.

When the shut-off valve is closed, the entire system is maintained at the pressure set by the pressure regulator. When the shut-off valve is opened, the pressure within the system immediately starts to drain through the discharge port. This discharge continues until equilibrium is reached with the incoming supply air. The equilibrium point is usually several PSI below the pressure as set on the pressure regulator due to internal frictional losses causing a reduction of air pressure. Since the bulk of the air contained in the system is located in the top of the tank, the air path from the top of the tank to the discharge port is critical. In the prior art, the junction between the top of the tank and the discharge port was made in such a manner that the air path was regularly filled with particulate matter from a previous blast cycle. As such, when the shut-off valve was first opened, this particulate matter was carried out of the discharge port as the machine equalized, causing a large surge of powder to be expelled from the nozzle. Secondarily, after the tank had equalized its pressure and expelled the burst of particulate, the regular blasting would commence, but not before the previously filled area refilled with particulate. This refilling action caused the flow of particulate out of the nozzle to be reduced for several seconds. Once the area was refilled with particulate, additional particulate would be properly directed out of the discharge port and steady state blasting would occur.

Because of the unique geometry of the present invention, no location for accumulation of particulate is permitted, thereby greatly reducing any start-up surge and secondary drop-out.

Reverse Flow Eliminated, Clean-Air Side Remains Clean

During the negative pressure swing of normal modulator operation there exists a positive pressure differential between the top of the tank and the mixing chamber, thereby creating airflow from the top of the tank into the mixing chamber. In the prior art, the bypass tube was connected to the mixing chamber downstream of the orifice, and this caused reverse airflow pulses that could push abrasive backwards toward the modulator and other clean-air only components of the system. In the present invention, the bypass tube 38 is relocated upstream of the orifice 34, relative to the prior art. Thus, the present system feeds abrasive particles or powder by modulating air, as in prior art system such as the MICRO-BLASTER® model sold by Comco, Inc. of Burbank, Calif., the assignee of the present application, but with the bypass tube relocated away from any powder, no abrasive is carried backwards during reverse modulation. This greatly extends the life of the modulator, as well as avoiding clean-air plumbing contamination.

Smoother Flow and Reduced Tank Wear

The present invention employs a unique tank and mixing chamber geometry which solves a long-standing problem in the prior art. Referring again particularly to FIGS. 1-3, compared to the prior art, the tank and mixing chamber geometry have been designed to minimize directional changes of the abrasive particles. As shown in the figures, modulated air enters the mixing chamber 36 at the left side thereof and passes beneath the orifice 34, gaining powder as previously detailed, and exits through the discharge port 41. The powder is not forced through any turns, and is therefore smooth and consistent. Further, because the route is so short, and because the abrasive particles are massive compared to the surrounding air molecules, and therefore accelerate slowly, the abrasive powder never reaches high speeds while in the mixing chamber, thus substantially reducing tank and mixing chamber wear. Any wear that does occur within the mixing chamber is almost entirely contained within the replaceable discharge port 41.

Particulate Media Resistant Valve Benefits

The particulate media resistant valve described herein has three main benefits over previous generations of similar devices. First, it can be run off of a single supply of air 105*f*, with the only criteria being that the air pressure be higher than the blast stream that the particulate media resistant valve is switching. This means that, in remote applications, it is very easy to pressurize the particulate media resistant valve by connecting it to the same supply pressure that is running the blaster. Since the blaster will either directly, via the pressure regulator, or indirectly, via friction, reduce the air pressure, the air pressure in the particulate media resistant valve will always be greater than the blast pressure. Previous particulate media resistant valves have required two specific air supplies: a 125 PSI supply to drive the piston back and forth, and blast pressure to provide a protective barrier (to protect the cylinder from incursion by abrasive particles). The 125 PSI supply has been required specifically to generate enough force to create a seal between the pliable seal and the discharge port. In some cases, a customer may not have 125 PSI available, in which case the particulate media resistant valve could leak. Further, prior art particulate media resistant valves were difficult to mount remotely, because plumbing in blast pressure to act as a protective barrier is generally not feasible, since the origin of the blast pressure air is off of the blast regulator (e.g. element 14) and not available on the outside of the blaster. Secondly, the inventive particulate media resistant valve uses a heavy spring to apply enough force to cause an air-tight seal between the pliable seal and the discharge port, reducing the air pressure required to operate the valve and creating a fail-safe shut-off mechanism. Lastly, the inventive particulate media resistant valve has its abrasive-susceptible internal parts (such as the piston 54, plain bearing 58, and cup seals 60) protected against abrasive contamination by the constantly maintained air pressure applied to port 48. That is, any time the abrasive particulate media dispensing system 10 is pressurized, port 48 sees a higher pressure. This higher pressure applied to port 48 creates a positive pressure gradient between the particulate media resistant valve and the mixing chamber. Should a leak develop (due to wear, for example), the natural course of flow will be from the particulate media resistant valve into the mixing chamber. In prior art particulate media resistant valves, if the blast pressure were set to 125 PSI or higher, the air flow direction through a leaky valve would be from the mixing chamber into the particulate media resistant valve, thereby carrying abrasive particles into the inside of the cylinder and causing rapid wear or seizing.

Further protection against contamination of the particulate media resistant valve 44 by abrasive particles intruding therein from adjacent areas such as the mixing chamber 36 is provided by a low clearance washer 106 which retains a plurality of felt wipers 108 along the rod 56.

Handpiece Assembly/Nozzle Benefits

The inventive handpiece and nozzle system has three key benefits over prior art handpiece and nozzle systems. First, the hose is connected directly to the nozzle, thereby containing all abrasive wear to two items. Prior art systems connect the hose to an intermediate member that serves as an adapter into which a nozzle can be screwed. This means that prior art systems have three wear items. Second, the inventive handpiece uses a floating ferrule to greatly reduce required operator hand torque when installing and removing the nozzle from the handpiece and tube. This is particularly useful when compared to prior art intermediate members which are typically seized onto the tube, and are very difficult to remove without cutting tools when the intermediate member needs to be replaced. Third, the handpiece assembly has a larger diameter and comes equipped with a contoured rubber grip to fit more naturally into an operator's hand. Comfort is further extended by connecting the tube to the nozzle under the operator's fingers, and allowing the reward-extending portion of the tube to float and begin any bending while still inside the handpiece tube. Prior art handpieces rigidly support the tube by the tube's outside surface all the way to the rear end of the handpiece, causing the operator to use more wrist torque when manipulating the nozzle, as compared to the inventive handpiece.

Summary of Some Advantages of the Present Invention

Objectives for the present invention, accordingly, are: 1) improve modulation pulse consistency and modulator life, 2) to easily adjust the steady state powder flow, 3) alleviate the start-up transient present in prior art systems, 4) prevent powder flow from infiltrating the clean side of the system, 5) to minimize abrasive wear in the tank, 6) create a simpler and more reliable particulate media-resistant shut-off valve, and 7) create a simpler handpiece and nozzle. As noted above, the present system accomplishes these seven primary objectives.

Alternative Particulate Media Resistant Valve Embodiment

Figure 6:
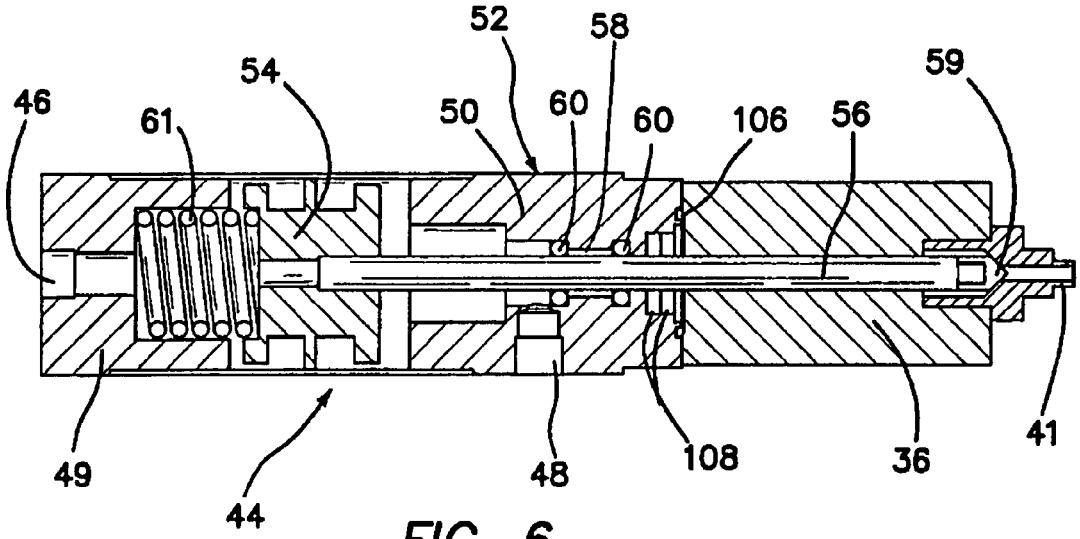
FIG. 6 is a cross-sectional view of particulate media resistant shut-off valve employed in the system of FIG. 1.
Figure 7:
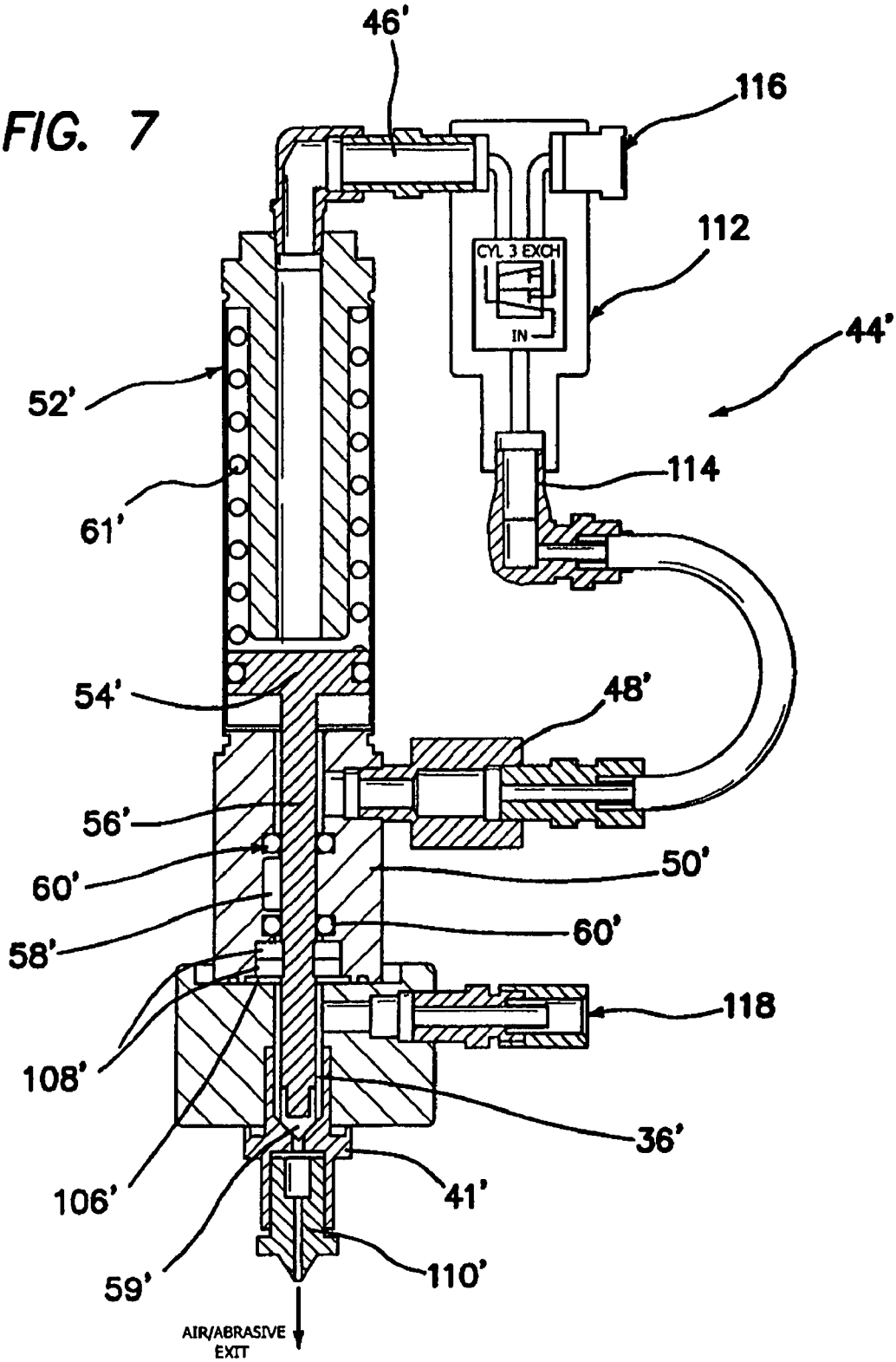
FIG. 7 is a cross-sectional view of a remotely-mounted Particulate media resistant valve which may alternatively be employed in the inventive system, or separately in other types of systems.

With reference now to FIG. 7, there is shown an alternative embodiment wherein like elements to those illustrated in the embodiments of FIGS. 1-6 are designated by like reference numerals, primed. In the FIG. 7 embodiment, the particulate media resistant valve 44' and mixing chamber 36' are mounted remotely from the tank 32. This remote mounting is a feasible option because of the innovative design which eliminates the prior art need for purge air, noted above. In this embodiment, the particulate media resistant valve 44' comprises an air cylinder 52' having a piston 54' connected to a piston rod 56'. The piston rod 56' is shortened compared to the piston rod 56 (FIG. 6) utilized in the alternate application, wherein the particulate media resistant valve 44 is integrated with the tank 32. A plain bearing 58' and a plurality of cup seals 60' are provided for facilitating reciprocation of the rod 56' and sealing same. A heavy spring 61' biases the piston 54' to a closed orientation, as in the embodiment shown in FIG. 6. The distal end of the piston rod 56' is covered by a pliable seal 59' that interfaces with the discharge port 41'. Further protection against contamination of the particulate media resistant valve 44' by abrasive particles intruding therein from adjacent areas such as the mixing chamber 36' is provided by the low clearance washer 106' which retains a plurality of felt wipers 101' along the rod 56', as in the FIG. 6 embodiment.

A three port, two-way valve 112 is provided which includes a first fluid port 46' and a second continuous high pressure fluid inlet port 48', corresponding to their equivalent numbered elements in the FIG. 6 embodiment. In an unenergized state of the valve 112, an "IN" port 114 is connected to the port 46', and a vent port 116 is closed. In this state, the air pressure entering each of ports 46' and 48' is equal, and the spring 61' thus functions to bias piston, rod, and pliable seal toward the discharge port 41' to the closed position.

In an energized state, on the other hand, the "IN" port 114 is blocked, and the first fluid port 46' is connected directly to the vent port 116. Consequently, the air pressure supplied to the port 48' functions to overcome the bias applied by the spring 61', thus moving the piston in a direction causing the discharge valve to open. An air/abrasive entrance 118 supplies an already mixed air/abrasive stream to the particulate media resistant valve for control. This stream may originate from a discharge port on an abrasive particulate dispensing system such as the inventive system described herein, for example. This remote particulate media resistant valve then acts as a shut-off mechanism much closer to the nozzle 110' to enable rapid blast starts and stops.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A tool for utilizing a particulate media and fluid mixture to modify a workpiece, comprising:

a handpiece assembly having a grip and a tube for receiving the particulate media and fluid mixture from a source, said tube extending through the grip from a proximal end to a distal end thereof;

a nozzle which is directly engageable with the distal end of the handpiece assembly; and a ferrule which is movable within the handpiece assembly to directly engage the nozzle with a distal end of the tube when the nozzle is attached to the handpiece assembly and to assist in disengaging the tube from the nozzle when the nozzle is detached from the handpiece assembly.

2. A tool for utilizing a particulate media and fluid mixture to modify a workpiece, comprising:

a handpiece assembly having a grip and a tube for receiving the particulate media and fluid mixture from a source, said tube extending through the grip from a proximal end to a distal end thereof, said handpiece assembly having female threads on a distal end thereof;

a nozzle having male threads on a proximal end thereof; and a ferrule which is movable within the handpiece assembly to engage the nozzle with a distal end of the tube when the nozzle is attached to the handpiece assembly and to assist in disengaging the tube from the nozzle when the nozzle is detached from the handpiece assembly;

wherein said nozzle is directly engageable with said handpiece assembly by threadedly engaging said male and female threads.

3. The tool as recited in claim 1, wherein said nozzle comprises a proximal fluid inlet nipple which is insertable into the distal tube end.

4. The tool as recited in claim 1, and further comprising male threads on said nozzle and female threads in the distal end of said handpiece, said nozzle being directly engageable with said handpiece assembly by threadedly engaging said male and female threads.

5. The tool as recited in claim 1, wherein said handpiece assembly grip has a relatively large diameter and is sized to cradle a user's fingers.

6. The tool as recited in claim 3, wherein said inlet nipple is fabricated from an abrasive resistant material.

7. The tool as recited in claim 6, wherein said abrasive resistant material is stainless steel.

8. The tool as recited in claim 1, wherein said particulate media comprises abrasive powder, and said tool comprises a cutting or finishing tool.

9. The tool as recited in claim 1, wherein said nozzle comprises a body, and said nozzle body has markings thereon for identifying predetermined characteristics of said nozzle.

10. The tool as recited in claim 1, wherein said handpiece assembly further comprises a handpiece nut.

11. The tool as recited in claim 10, wherein said ferrule is captured between said handpiece nut and said handpiece tube.

12. The tool as recited in claim 11, wherein when said handpiece assembly is connected to said nozzle, said ferrule cinches said tube.

13. A method of assembling and disassembling a tool for utilizing a particulate media and fluid mixture to modify a workpiece, wherein said tool comprises a handpiece assembly having a grip and a tube for receiving the particulate media and fluid mixture from a source, said tube extending through the grip from a proximal end to a distal end thereof, a nozzle, and a ferrule which is movable within the handpiece assembly to engage the tube to the nozzle when the nozzle is attached to the handpiece assembly and to assist in disengaging the nozzle when the nozzle is detached from the handpiece assembly, said method comprising:

connecting a distal end of the tube to an inlet nipple on the nozzle; and connecting a distal end of the handpiece assembly to a proximal end of the nozzle.

14. The method as recited in claim 13, wherein the step of connecting the distal end of the handpiece assembly to the proximal end of the nozzle is performed by threadedly engaging the two components.

15. The method as recited in claim 13, wherein the ferrule cinches the tube during the step of connecting the distal end of the handpiece assembly to the proximal end of the nozzle.

16. The method as recited in claim 13, wherein the ferrule creates a pressure tight seal between the tube and the nipple, and reduces the amount of torque which would otherwise be required to perform the step of connecting the distal end of the handpiece assembly to the proximal end of the nozzle.

17. The method as recited in claim 14, and further comprising a step of disconnecting the nozzle from the handpiece assembly by unthreading the nozzle from the handpiece assembly, wherein the ferrule remains attached to the tube/nipple interface during the unthreading step in order to render the unthreading process easier to accomplish.

18. The method as recited in claim 17, and further comprising a step of tipping the nozzle to separate the nozzle from the tube.

* * * * *